US009500189B2

(12) United States Patent
Park

(10) Patent No.: US 9,500,189 B2
(45) Date of Patent: Nov. 22, 2016

(54) STRUCTURE OF VARIABLE SWASH PLATE TYPE COMPRESSOR

(71) Applicant: Hyundai Motor Company, Seoul (KR)

(72) Inventor: Nam-Ho Park, Whasung (KR)

(73) Assignee: Hyundai Motor Company, Seoul (KR)

( * ) Notice: Subject to any disclaimer, the term of this patent is extended or adjusted under 35 U.S.C. 154(b) by 353 days.

(21) Appl. No.: 14/106,754

(22) Filed: Dec. 14, 2013

(65) Prior Publication Data

US 2015/0064028 A1 Mar. 5, 2015

(30) Foreign Application Priority Data

Aug. 27, 2013 (KR) ..... 10-2013-0101452

(51) Int. Cl.
*F04B 27/10* (2006.01)

(52) U.S. Cl.
CPC ..... *F04B 27/1072* (2013.01); *F04B 27/1054* (2013.01)

(58) Field of Classification Search
CPC ..... F04B 27/086; F04B 27/0865; F04B 27/1063; F04B 27/1072; F04B 27/1054; F04B 2027/18–2027/189
See application file for complete search history.

(56) References Cited

U.S. PATENT DOCUMENTS 4,178,135 A * 12/1979 Roberts ..... F04B 27/1072 417/222.2
4,850,811 A 7/1989 Takai
5,239,913 A * 8/1993 Terauchi ..... F04B 27/1063 384/620
6,146,107 A * 11/2000 Kawaguchi ..... F04B 27/1072 417/222.1

FOREIGN PATENT DOCUMENTS

KR 2002-0039144 A 5/2002
KR 10-0834768 B1 6/2008

* cited by examiner

*Primary Examiner* — Devon Kramer
*Assistant Examiner* — Kenneth J Hansen
(74) *Attorney, Agent, or Firm* — Morgan, Lewis & Bockius LLP

(57) ABSTRACT

A structure of a variable swash plate compressor includes: a rotatable shaft having a flow path through which a refrigerant flows; a rotor fixed and coupled to the shaft and has a rotor arm formed at one side of the rotor; a swash plate connected to the rotor arm by a hinge pin and mounted on the shaft so that an inclination angle is variable with respect to the shaft; a compressive coil spring installed on the shaft between the swash plate and the rotor; a lift slidably coupled to the shaft and connected to the swash plate; and a fixing device formed in the shaft and fixes the lift so as to maintain the inclination angle of the swash plate, thereby basically preventing an operational delay of the compressor, securing performance at the time of initially operating an air conditioning device, and improving marketability.

4 Claims, 5 Drawing Sheets

STRUCTURE OF VARIABLE SWASH PLATE TYPE COMPRESSOR

CROSS-REFERENCE TO RELATED APPLICATIONS

The present application claims priority of Korean Patent Application Number 10-2013-0101452 filed Aug. 27, 2013, the entire contents of which application is incorporated herein for all purposes by this reference.

BACKGROUND OF INVENTION

Field of Invention

The present invention relates to a structure of a variable swash plate type compressor that is used to circulate a refrigerant in an air conditioning device for a vehicle, and more particularly, to a structure of a variable swash plate type compressor capable of securing performance of initially operating an air conditioner and improving performance of controlling a compressor by providing a fixing device in a shaft and fixing an inclination angle of a swash plate of the variable swash plate type compressor for a vehicle.

Description of Related Art

In general, an air conditioning device for a vehicle is used to provide a fresh environment and a more convenient location for operation by a driver by maintaining a temperature in the vehicle in an appropriate state regardless of variation of an outside temperature, and by properly maintaining humidity and air environment in the vehicle in accordance with the driver's requirement.

In addition, in general, the air conditioning device for a vehicle includes a compressor which compresses a refrigerant, a condenser which condenses and liquefies the refrigerant compressed by the compressor, an expansion valve which adiabatically expands the liquefied refrigerant so as to make a refrigerant in a low temperature and low pressure state, and an evaporator and other accessories and components which lower a temperature of air and adjust humidity by exchanging heat with air in an interior of the vehicle using the expanded refrigerant.

In this case, the compressor serves to compress the gaseous refrigerant in a low temperature and low pressure state, which is discharged from the evaporator, so as to make a gaseous refrigerant in a high temperature and high pressure state, and is configured to discharge the refrigerant to the condenser.

As the compressor, various types of compressors are used, and as a representative compressor, a swash plate type compressor, a vane rotary type compressor, and a wobble plate type compressor are widely used.

Among the compressors, the swash plate type compressor may be classified into a fixed capacity type compressor in which an inclination angle of a swash plate is fixed, and a variable capacity type compressor in which an inclination angle of a swash plate is adjustable, and a structure of a variable capacity type (variable swash plate type) compressor of the related art is illustrated in FIG. 1.

As illustrated in FIG. 1, the compressor has a rotor 2 and a swash plate 3 which are mounted side by side on a shaft 1 that is connected to a crank shaft of an engine by a belt so as to be rotated. A rotor arm 5 protrudes on the rotor 2 toward the swash plate 3, and a slot hole shaped long in length is formed in the rotor arm 5.

The rotor arm 5 and the swash plate 3 are connected to each other by a hinge pin 6 so that the swash plate 3 rotates while varying an inclination angle with respect to the shaft

1. In addition, a compressive coil spring 4 is installed between the swash plate 3 and the rotor 2 so as to apply force that allows the swash plate 3 to be restored to an initial position.

The aforementioned variable swash plate type compressor adjusts the inclination angle of the swash plate 3 (that is, adjusts a size of a stroke of a piston connected to the swash plate 3), thereby varying the amount of discharging the refrigerant.

However, in the variable swash plate type compressor of the related art, it takes several seconds to adjust the inclination angle of the swash plate 3 from a minimum value to a maximum value at the time of initially operating the air conditioning device, and therefore, there is problem in that an initial operation of the air conditioning device is delayed.

In addition, torque of the compressor is varied when the inclination angle of the swash plate 3 is varied at the time of initially operating the air conditioning device, and therefore, there is a problem in that the variation in torque of the compressor has an adverse effect on performance of controlling the engine and the compressor.

The information disclosed in this Background section is only for enhancement of understanding of the general background of the invention and should not be taken as an acknowledgement or any form of suggestion that this information forms the prior art already known to a person skilled in the art.

BRIEF SUMMARY

Various aspects of the present invention provide for a structure of a variable swash plate type compressor capable of basically preventing an operational delay at the time of initially operating an air conditioning device by forming a fixing device, which may maintain an inclination angle of a swash plate, in a shaft and fixing the inclination angle of the swash plate.

Various aspects of the present invention provide for a structure of a variable swash plate type compressor including: a shaft which is rotated and has a flow path formed therein so that a refrigerant flows in the flow path; a rotor which is fixed and coupled to the shaft and has a rotor arm formed at one side of the rotor; a swash plate which is connected to the rotor arm by a hinge pin and mounted on the shaft so that an inclination angle is variable with respect to the shaft; a compressive coil spring which is installed on the shaft between the swash plate and the rotor; a lift which is slidably coupled to the shaft and connected to the swash plate; and a fixing device which is formed in the shaft and fixes the lift so as to maintain the inclination angle of the swash plate.

In addition, the fixing device may include: a valve which is slidably inserted into a space portion formed in the shaft and has a flow path that is formed to penetrate the valve in a longitudinal direction so that the refrigerant flows therethrough; a spring which is coupled to the valve and pushes the valve in a direction opposite to a direction in which the refrigerant flows; and a protruding portion which is formed between the space portion of the shaft and an outer circumferential surface of the shaft and is capable of protruding to the outside of the shaft in accordance with a movement of the valve.

In addition, the protruding portion may include: a ball which is formed in a spherical shape and comes into contact with the valve so as to be capable of protruding to the outside of the shaft; and a ball seat portion which is formed to penetrate a portion between the space portion of the shaft and the outer circumferential surface of the shaft and provide a space in which the ball is able to be accommodated.

Moreover, the protruding portion may be formed in plural numbers along a circumference of the shaft.

Moreover, the ball seat portion may be formed in a cylindrical shape of which a center portion, where a diameter of a portion in contact with an outer circumferential surface of the space portion and a diameter of a portion in contact with the outer circumferential surface of the shaft are smaller than a diameter between the space portion and the outer circumferential surface of the shaft, is convexly inflated.

According to various aspects of the present invention, the structure of the variable swash plate type compressor includes the lift which is slidably coupled to the shaft and connected to swash plate, and the fixing device which is formed in the shaft and fixes the lift, thereby basically preventing an operational delay of the compressor by fixing the inclination angle of the swash plate so that the inclination angle of the swash plate is not varied at the time of initially operating the air conditioning device.

In addition, the structure of the variable swash plate type compressor secures performance at the time of initially operating the air conditioning device, thereby improving marketability of the vehicle.

Moreover, the inclination angle of the swash plate is fixed at the time of initially operating the air conditioning device such that torque of the compressor is constant, thereby improving performance of controlling the engine and the compressor.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1:
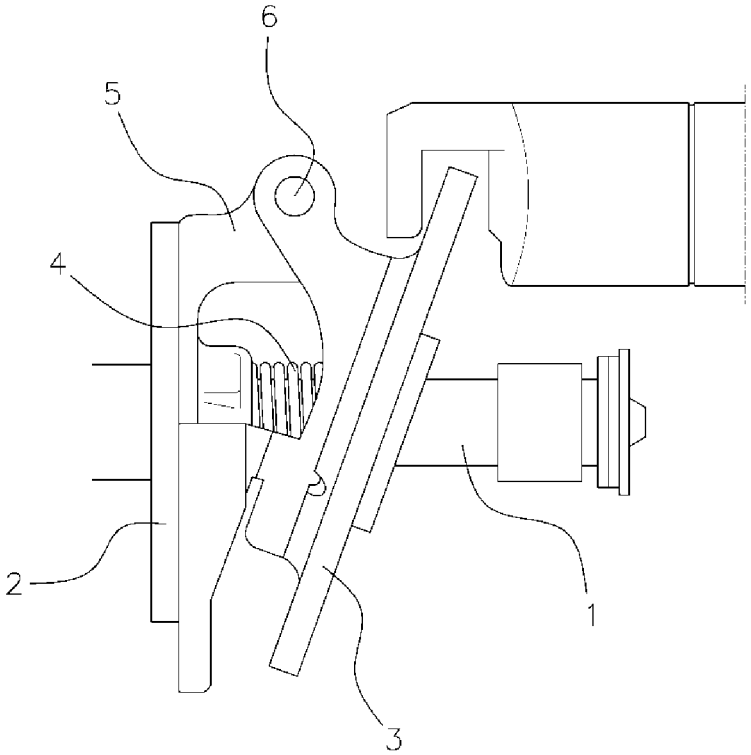
FIG. 1 (Related Art)
FIG. 1 is a cross-sectional view illustrating a structure of a variable swash plate type compressor of the related art.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A structure of a variable swash plate type compressor according to the present invention may include a shaft 10 which is rotated and has a flow path formed therein so that a refrigerant flows in the flow path, a rotor 20 which is fixed and coupled to the shaft 10 and has a rotor arm 22 formed at one side of the rotor 20, a swash plate 30 which is connected to the rotor arm 22 by a hinge pin 32 and mounted on the shaft 10 so that an inclination angle is variable with respect to the shaft 10, a compressive coil spring 40 which is installed on the shaft 10 between the swash plate 30 and the rotor 20, a lift 50 which is slidably coupled to the shaft 10 and connected to the swash plate 30, and a fixing device 60 which is formed in the shaft 10 and fixes the lift 50 so as to maintain the inclination angle of the swash plate 30.

Figure 2:
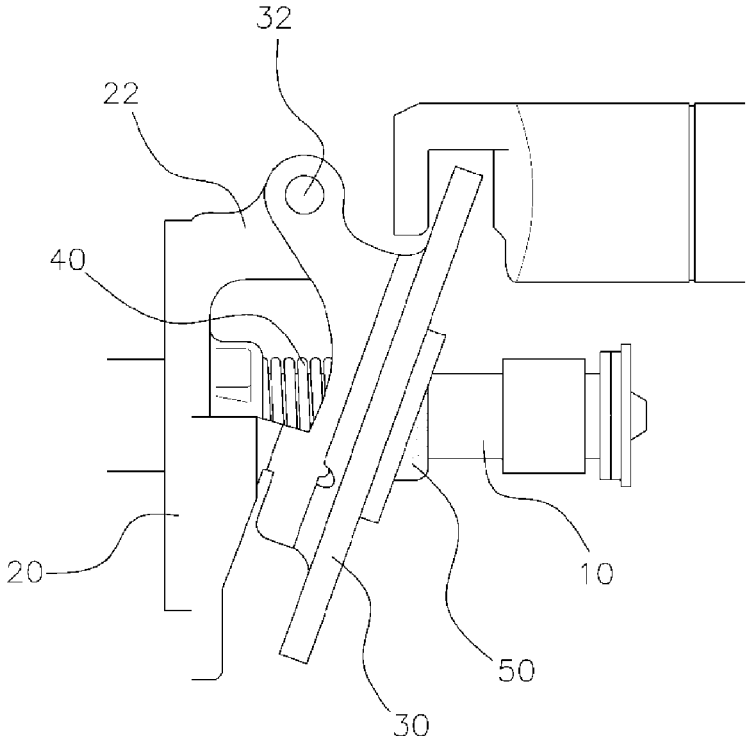
FIG. 2 is a cross-sectional view illustrating a structure of an exemplary variable swash plate type compressor according to the present invention.
Figure 3:
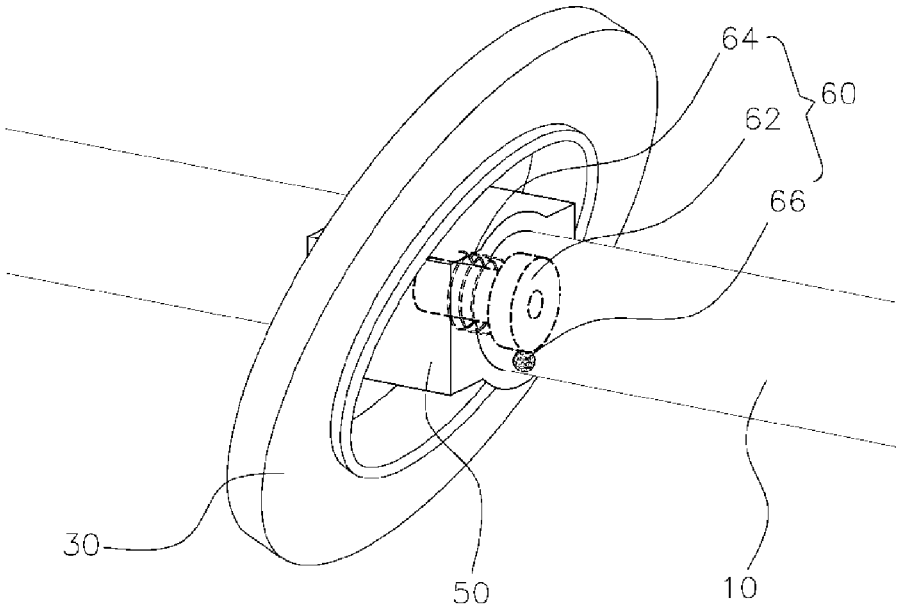
FIG. 3 is an enlarged view illustrating an aspect in which part A of FIG. 2 is enlarged.
Figure 4:
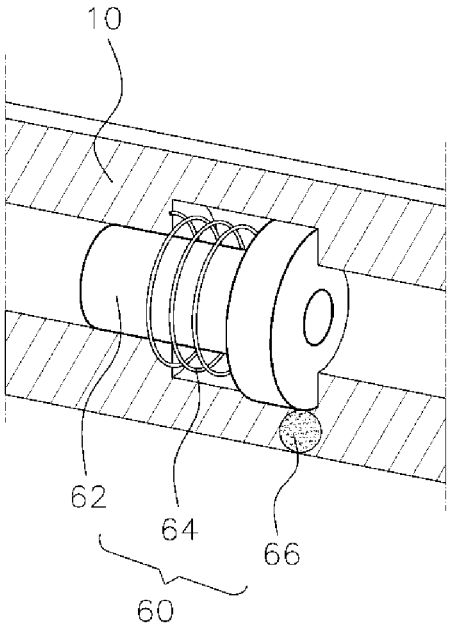
FIG. 4 is a perspective view illustrating an aspect of the interior of an exemplary shaft according to the present invention.

As illustrated in FIGS. 2 to 4, the shaft 10 is connected to a crank shaft (not illustrated) of an engine by a belt so as to be rotated, and has the flow path formed therein so that the refrigerant flows in the flow path.

The inclination angle of the swash plate 30 is determined by a difference between pressure in a swash plate chamber, which is formed by transferring the refrigerant discharged to the outside of the compressor into the swash plate chamber through the flow path in the shaft 10, and pressure of a sucked refrigerant that is sucked into the compressor.

As illustrated in FIG. 2, the circular plate-shaped rotor 20 having the rotor arm 22 formed at one side of the rotor 20 and the swash plate 30 are mounted side by side on the shaft 10, and the rotor 20 and the swash plate 30 are connected to each other by the hinge pin 32 so that the inclination angle of the swash plate 30 is variable.

A compressive coil spring 40 is installed between the swash plate 30 and the rotor 20 so as to apply force that allows the swash plate 30 to be restored to an initial position.

That is, in various embodiments, force, which allows the swash plate 30 to be always restored in the right direction, is applied by the compressive coil spring 40, and thereby, the swash plate 30 always tends to maintain the inclination angle to the minimum value.

As illustrated in FIG. 3, the lift 50, which is slidably coupled to the shaft 10, is coupled to the swash plate 30 on the shaft 10.

The lift 50 has an inner diameter, which is the same as an outer diameter of the shaft 10, and is coupled to the shaft 10 so as to be moved in the left and right directions in accordance with the inclination angle of the swash plate 30. Specifically, when the inclination angle of the swash plate 30 is a minimum value (about 0.5°), the lift 50 is moved in the right direction, and as the inclination angle of the swash plate 30 is increased (a maximum value is about 23°), the lift 50 is moved in the left direction.

That is, the lift 50 is moved on the shaft 10 in the left and right directions correspondingly to the inclination angle of the swash plate 30 which is varied depending on pressure inside the compressor, which is applied through the flow path of the shaft 10, and suction pressure of the refrigerant, and the swash plate 30 is also connected to the lift 50 to be associated with each other so that the inclination angle is varied depending on the movement of the lift 50.

As illustrated in FIGS. 3 and 4, a fixing device 60, which fixes the lift 50 and maintains the inclination angle of the swash plate 30 connected to the lift 50, is formed in the shaft 10.

As the fixing device 60, an electronic fixing device which detects pressure of the refrigerant in the compressor and suction pressure of the refrigerant using a sensor, and fixes the lift 50 based on electrical signals using an electromagnet or the like, or a mechanical fixing device which is formed in the shaft 10 and has a protrusion or the like, which protrudes to the outside of the shaft 10 in accordance with pressure of the refrigerant that is sent to the shaft 10, to fix the lift 50 may be utilized.

Specifically, as illustrated in FIG. 4, the fixing device 60 may include a valve 62 which is slidably inserted into a space portion formed in the shaft 10 and has a flow path that is formed to penetrate the valve 62 in a longitudinal direction so that the refrigerant flows therethrough, a spring 64 which is coupled to the valve 62 and pushes the valve 62 in a direction opposite to a direction in which the refrigerant flows, and a protruding portion 66 which is formed between the space portion of the shaft 10 and an outer circumferential surface of the shaft 10 and is capable of protruding to the outside of the shaft 10 in accordance with a movement of the valve 62.

Figure 5:
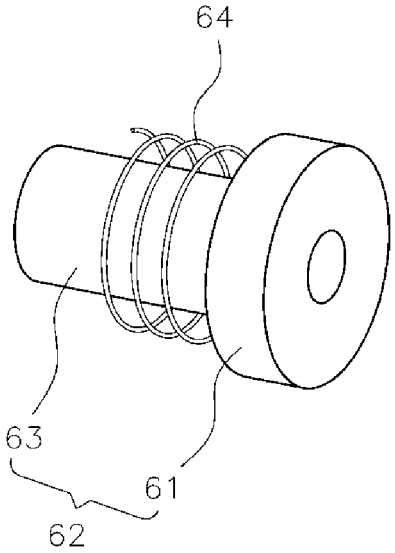
FIG. 5 is a perspective view illustrating aspects of an exemplary valve and spring according to the present invention.

As illustrated in FIG. 5, the valve 62 includes a valve head portion 61 having a relatively large outer diameter, and a valve body portion 63 having a relatively small outer diameter, and the space portion has a diameter that is the same as the outer diameter of the valve head portion 61.

The spring 64 is disposed on the valve body portion 63, and in various embodiments, the spring 64 serves to push the valve 62 between the valve head portion 61 and an end of the space portion in a direction opposite to a direction in which the refrigerant flows, that is, in the right direction.

The protruding portion 66, which is capable of protruding to the outside of the shaft 10 in accordance with the movement of the valve 62, is formed between the space portion of the shaft 10 and the outer circumferential surface of the shaft 10.

In various embodiments of the present invention, the protruding portion 66 may be elastically supported between the outer circumferential surface and the space portion of the shaft 10, and is formed as a block which has an inclined surface formed at one surface corresponding to the valve 62, and protrudes to the outside of the shaft 10 when the valve 62 pushes the inclined surface, or an aspect in which the protruding portion 66 is formed as a plate which has a center portion pivotably coupled between the outer circumferential surface and the space portion of the shaft 10, and protrudes to the outside of the shaft 10 when the plate pivots about a pivot center of the plate as the valve 62 pushes one side of the plate.

Figure 6:
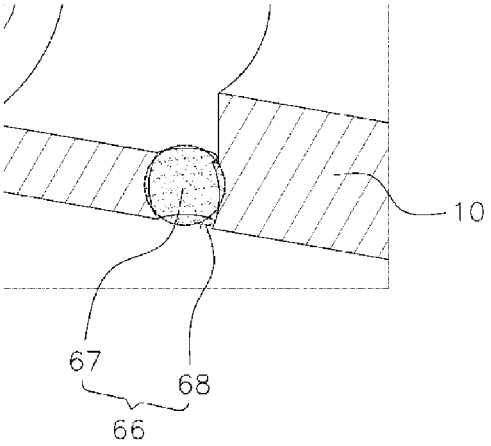
FIG. 6 is a perspective view illustrating aspects of an exemplary ball and ball seat portion according to the present invention.

As illustrated in FIG. 6, in various embodiments according to the present invention, the protruding portion 66 may include a ball 67 which is formed in a spherical shape and comes into contact with the valve 62 so as to be capable of protruding to the outside of the shaft 10, and a ball seat portion 68 which is formed to penetrate a portion between the space portion of the shaft 10 and the outer circumferential surface of the shaft and provides a space in which the ball 67 may be accommodated.

Figure 7:
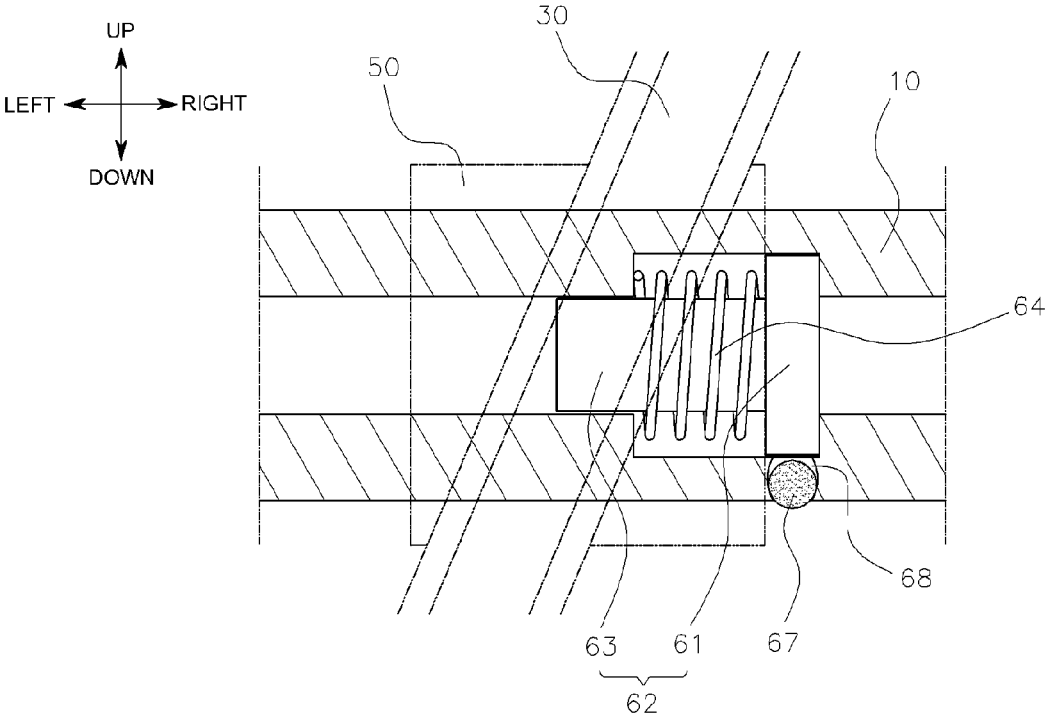
FIG. 7 is a cross-sectional view in which a part of the shaft is cut so as to illustrate an aspect when an exemplary variable swash plate type compressor is initially operated, in the structure of the variable swash plate type compressor according to the present invention.

That is, as illustrated in FIG. 7, the ball 67 protrudes to the outside of the shaft 10 by being pushed by the valve 62 in a state in which the valve 62 is moved in the right direction by the spring 64, and therefore, the ball 67 forms a protrusion at the outside of the shaft 10 such that the lift 50 is not moved in the right direction but is fixed because the lift 50 is locked by the protrusion.

Figure 8:
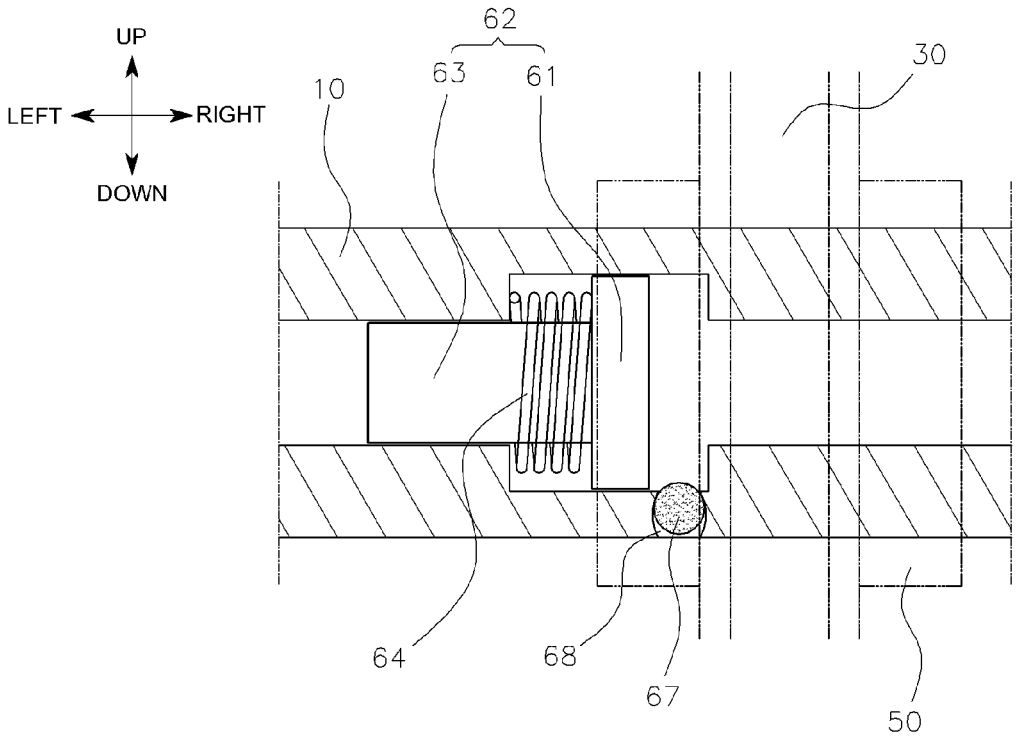
FIG. 8 is a cross-sectional view in which a part of the shaft is cut so as to illustrate an aspect when an inclination angle of a swash plate is the lowest, in the structure of an exemplary variable swash plate type compressor according to the present invention.

As illustrated in FIG. 8, when the valve 62 is moved in the left direction while overcoming elastic force of the spring 64 as the pressure inside the shaft 10 is raised, the ball 67 is moved into the ball seat portion 68, and the lift 50 is freely moved, thereby allowing the inclination angle of the swash plate 30 to be decreased.

In addition, as illustrated in FIG. 6, the ball seat portion 68 according to various embodiments of the present invention is formed in a cylindrical shape of which a center portion, where a diameter of a portion in contact with an outer circumferential surface of the space portion and a diameter of a portion in contact with the outer circumferential surface of the shaft 10 are smaller than a diameter between the space portion and the outer circumferential surface of the shaft 10, is convexly inflated.

That is, the ball seat portion 68 is entirely formed in a barrel shape, the ball 67 is positioned at the center portion of the ball seat portion 68 which has a relatively large diameter when the valve 62 does not push the ball 67, and the ball 67 protrudes to a portion of the ball seat portion 68 which has a relatively small diameter and comes into contact with the outer circumferential surface of the shaft 10 only when the valve 62 pushes the ball 67.

In addition, in various embodiments, because a vertical length of the ball seat portion 68 is relatively and slightly smaller than that of the ball 67, the ball may slightly protrude in a direction toward an inside of the shaft 10 when the valve 62 does not support the ball.

An operational process of the structure of the variable swash plate type compressor according to the present invention will be described below.

As illustrated in FIG. 7, pressure of the refrigerant which flows through the flow path in the shaft 10 at the time of initially operating the air conditioning device is lower than elastic force of the spring 64 that supports the valve 62.

Accordingly, the valve 62 is moved in the right direction in illustrated embodiments, and as the valve 62 is moved in the right direction, the head portion 61 of the valve pushes the ball 67 such that the ball 67 protrudes to the outside of the shaft 10.

As described above, as the ball 67 protrudes to the outside of the shaft 10, the lift 50 may not be moved in the right direction even though the compressive coil spring 40 installed on the shaft 10 exerts force in the right direction, but is locked and fixed by the ball 67.

As the lift 50 is fixed by the ball 67, the inclination angle of the swash plate 30 connected to the lift 50 is also fixed to a maximum value, and cooling performance is instantly shown without an operational delay at the time of initially operating the air conditioning device.

In contrast, as illustrated in FIG. 8, when the refrigerant, which flows through the flow path in the shaft 10, excessively flows, pressure of the refrigerant becomes higher than elastic force of the spring 64 that supports the valve 62.

Accordingly, in the illustrated embodiments, the valve 62 is moved in the left direction, and as the valve 62 is moved in the left direction, the ball 67 is moved into the ball seat portion 68.

As the ball 67 is moved into the ball seat portion 68, the lift 50 may be freely moved, and the lift 50 is moved in the right direction by force in the right direction applied by the compressive coil spring 40 that is installed on the shaft 10.

As the lift 50 is moved in the right direction, the inclination angle of the swash plate 30 connected to the lift 50 also has a minimum value, and the compressor maximally reduces an amount of discharging the refrigerant.

Figure 9:
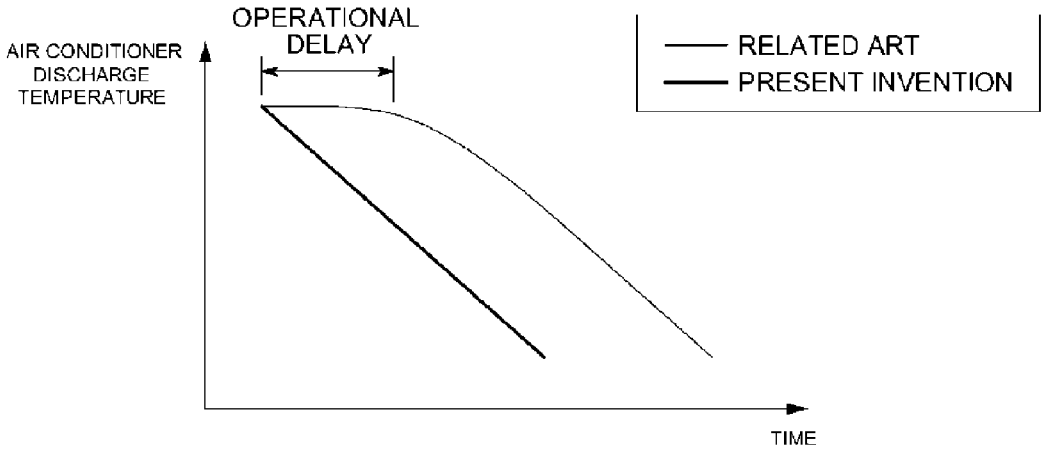
FIG. 9 is a graph for comparing discharge temperatures with respect to time in air conditioning devices having the structure of the variable swash plate type compressor of the related art and the structure of an exemplary variable swash plate type compressor according to the present invention.

As illustrated in FIG. 9, in comparison with the structure of the variable swash plate type compressor of the related art, the structure of the variable swash plate type compressor including the fixing device 60 according to the present invention may significantly reduce an operational delay at the time of an initial operation, thereby improving performance at the time of initially operating the air conditioning device, and the swash plate 30 is fixed at the time of an initial operation such that torque of the compressor is constant, thereby improving performance of controlling the engine and the compressor.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A structure of a variable swash plate compressor comprising:

a rotatable shaft including a flow path formed therein through which a refrigerant flows;

a rotor fixed and coupled to the shaft, the rotor including a rotor arm formed at one side of the rotor;

a swash plate connected to the rotor arm by a hinge pin and mounted on the shaft so that an inclination angle is variable with respect to the shaft;

a compressive coil spring installed on the shaft between the swash plate and the rotor;

a lift slidably coupled to the shaft and connected to the swash plate; and a fixing device including:

a valve slidably inserted into a space portion formed in the shaft and having a flow path that is formed to penetrate the valve in a longitudinal direction so that the refrigerant flows therethrough;

a valve spring coupled to the valve to push the valve in a direction opposite to a direction in which the refrigerant flows; and a protruding portion formed between the space portion of the shaft and an outer circumferential surface of the shaft and protruding to an outside of the shaft in accordance with a movement of the valve.

2. The structure of claim 1, wherein the protruding portion includes:

a ball formed in a spherical shape and comes into contact with the valve so as to protrude to the outside of the shaft; and a ball seat portion formed to penetrate a portion between the space portion of the shaft and the outer circumferential surface of the shaft and provide a space in which the ball is accommodated.

3. The structure of claim 1, wherein the protruding portion includes a plurality of protruding portions formed along a circumference of the shaft.

4. The structure of claim 2, wherein the ball seat portion is cylindrical including a center portion, where a diameter of a portion in contact with an outer circumferential surface of the space portion and a diameter of a portion in contact with the outer circumferential surface of the shaft are smaller than a diameter between the space portion and the outer circumferential surface of the shaft, and wherein the ball seat portion has a convex shape.

* * * * *